US011700887B2

(12) United States Patent
Li et al.

(10) Patent No.: US 11,700,887 B2
(45) Date of Patent: Jul. 18, 2023

(54) ELECTRONIC CIGARETTE

(71) Applicant: LANTO ELECTRONIC LIMITED, Kunshan (CN)

(72) Inventors: Bin Li, Kunshan (CN); Lin Wu, Kunshan (CN); Xin Tian, Kunshan (CN)

(73) Assignee: LANTO ELECTRONIC LIMITED, Kunshan (CN)

( * ) Notice: Subject to any disclaimer, the term of this patent is extended or adjusted under 35 U.S.C. 154(b) by 365 days.

(21) Appl. No.: 17/032,681

(22) Filed: Sep. 25, 2020

(65) Prior Publication Data

US 2021/0112865 A1 Apr. 22, 2021

(30) Foreign Application Priority Data

Oct. 18, 2019 (CN) ..... 201921758603.2

(51) Int. Cl.

| | |
|---|---|
| ***A24F 40/42*** | (2020.01) |
| ***A24F 40/10*** | (2020.01) |
| ***A24F 40/485*** | (2020.01) |
| ***A24F 40/46*** | (2020.01) |

(52) U.S. Cl.

CPC ..... *A24F 40/42* (2020.01); *A24F 40/10* (2020.01); *A24F 40/46* (2020.01); *A24F 40/485* (2020.01)

(58) Field of Classification Search

CPC ..... A24F 40/40; A24F 40/42; A24F 40/10; A24F 40/46; A24F 40/485

See application file for complete search history.

(56) References Cited

U.S. PATENT DOCUMENTS

2015/0189919 A1* 7/2015 Liu ..... A24F 40/40 131/329

FOREIGN PATENT DOCUMENTS

| | | | | |
|---|---|---|---|---|
| CN | 103315402 A | | 9/2013 | |
| CN | 204907926 U | | 12/2015 | |
| CN | 108065454 A | | 5/2018 | |
| CN | 208286374 U | | 12/2018 | |
| CN | 109805460 A | * | 5/2019 | |
| CN | 109982734 A | * | 7/2019 | ..... A24B 15/167 |
| WO | WO-2017143865 A1 | * | 8/2017 | ..... A24F 40/10 |

* cited by examiner

*Primary Examiner* — Jean F Duverne
(74) *Attorney, Agent, or Firm* — Cheng-Ju Chiang

(57) ABSTRACT

The present disclosure discloses an electronic cigarette. The electronic cigarette includes a cigarette pipe having a cavity, an atomizer device received in the cavity and a cartridge detachably mounted to the atomizer device. The atomizer device is provided with a heating element. The cartridge includes a main body inserted in the cavity, a channel extending through the main body, an e-liquid storage member detachably installed in the main body, and an e-liquid carrier. The channel is in communication with the outside. The e-liquid carrier is received in the channel. The e-liquid carrier is capable of absorbing e-liquid in the e-liquid storage member. The heating element includes a heating end extending into the e-liquid carrier.

20 Claims, 6 Drawing Sheets

ELECTRONIC CIGARETTE

CROSS-REFERENCE TO RELATED APPLICATION

This patent application claims priority of a Chinese Patent Application No. 201921758603.2, filed on Oct. 18, 2019 and titled "ELECTRONIC CIGARETTE", the entire content of which is incorporated herein by reference.

TECHNICAL FIELD

The present disclosure relates to a technical field of electronic cigarettes, and in particular to an electronic cigarette which can be reused.

BACKGROUND

Electronic cigarettes appear because it produces a large amount of harmful gases when tobacco is burned, which causes greater harm to people and the environment. At present, most electronic cigarettes in the market have atomizers installed with the cartridges. Therefore, the cartridges will be discarded with the atomizers after the e-liquid is used up, which causes a waste of resources.

Therefore, it is necessary to provide a new electronic cigarette to solve the above problems.

SUMMARY

An object of the present disclosure is to provide an electronic cigarette which can be reused.

In order to achieve the above object, the present disclosure adopts the following technical solution: an electronic cigarette including a cigarette pipe having a cavity, an atomizer device received in the cavity, and a cartridge detachably mounted to the atomizer device. The atomizer device is provided with a heating element. The cartridge includes a main body inserted in the cavity, a channel extending through the main body, an e-liquid storage member detachably installed in the main body, and an e-liquid carrier. The channel is in communication with the outside. The e-liquid carrier is received in the channel. The e-liquid carrier is capable of absorbing e-liquid in the e-liquid storage member. The heating element includes a heating end extending into the e-liquid carrier.

Compared with the prior art, the electronic cigarette disclosed in the present disclosure has the cartridge detachably installed in the atomizer device. After the e-liquid in the cartridge is used up, a new cartridge can be replaced to mate with the atomizer device. As a result, the atomizer device of the electronic cigarette can be reused, which avoids waste of resources.

DETAILED DESCRIPTION

Figure 1:
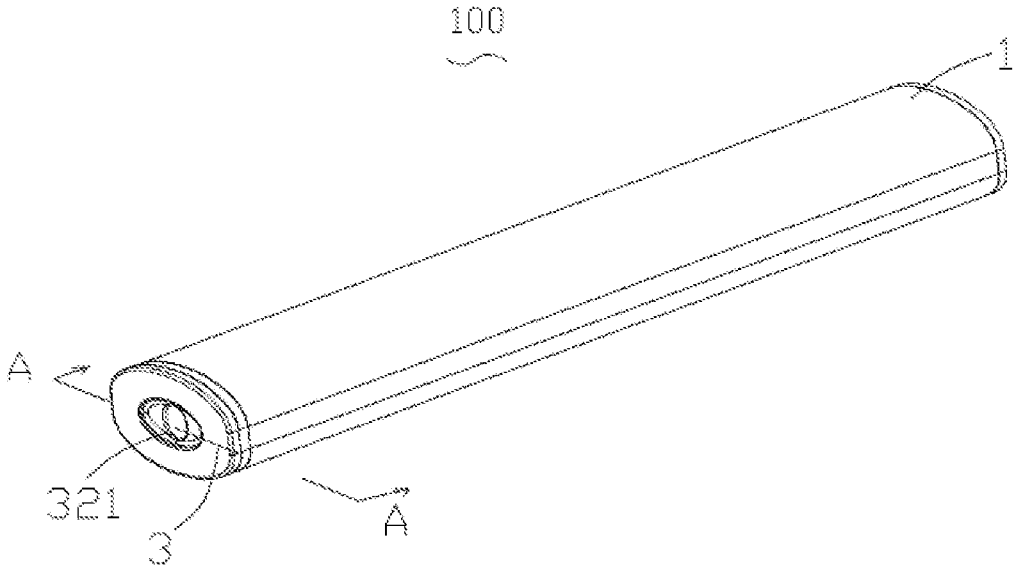
FIG. 1 is a schematic perspective view of an electronic cigarette in accordance with an embodiment of the present disclosure.
Figure 2:
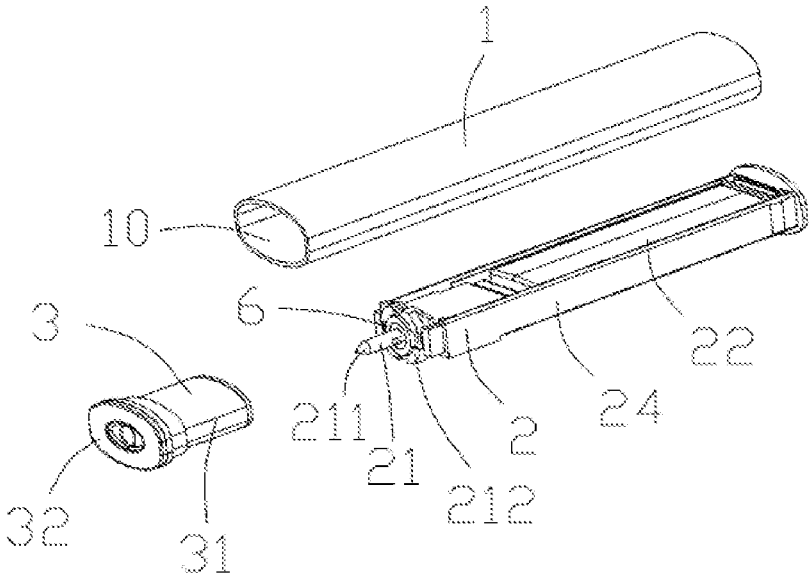
FIG. 2 is a partial exploded perspective view of FIG. 1.

Referring to FIGS. 1 to 6, the present disclosure discloses an electronic cigarette 100. The electronic cigarette 100 includes a cigarette pipe 1, an atomizer device 2 received in a cavity 10 of the cigarette pipe 1, and a cartridge 3.

Figure 3:
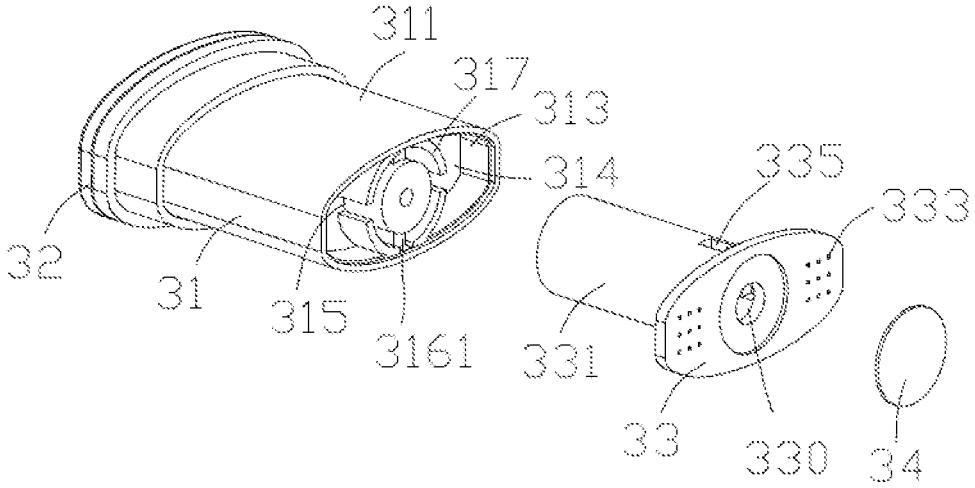
FIG. 3 is a partial exploded schematic view of a cartridge.
Figure 4:
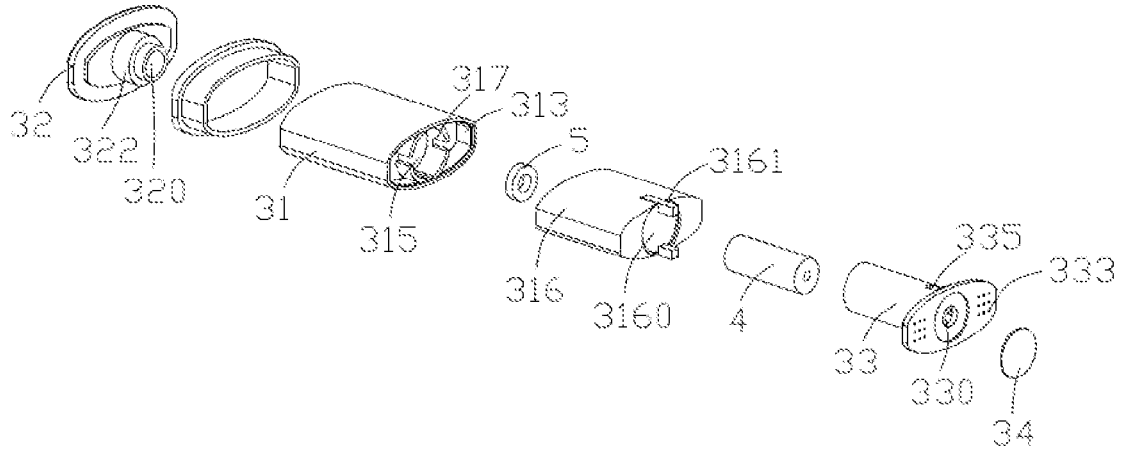
FIG. 4 is a further exploded perspective view of FIG. 3.

As shown in FIGS. 3 and 4, the cartridge 3 includes a main body 31 inserted into the cavity 10, a first end plate 32 shielding one end of the main body 31, and an e-liquid carrier 4 received in the main body 31. In an embodiment of the present disclosure, the e-liquid carrier 4 is a glass fiber cotton core. The above mentioned e-liquid is, for example, aerosol-generating liquid with or without nicotine.

Figure 5:
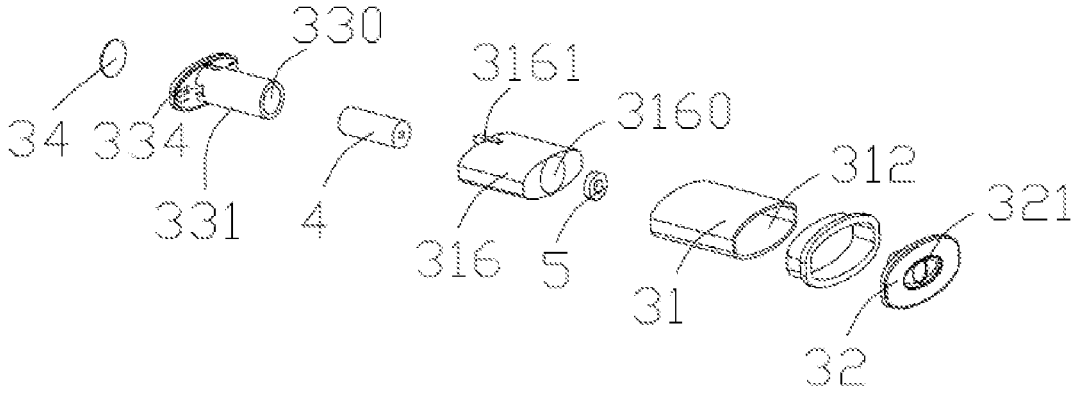
FIG. 5 is a schematic view of FIG. 4 from another angle.
Figure 6:
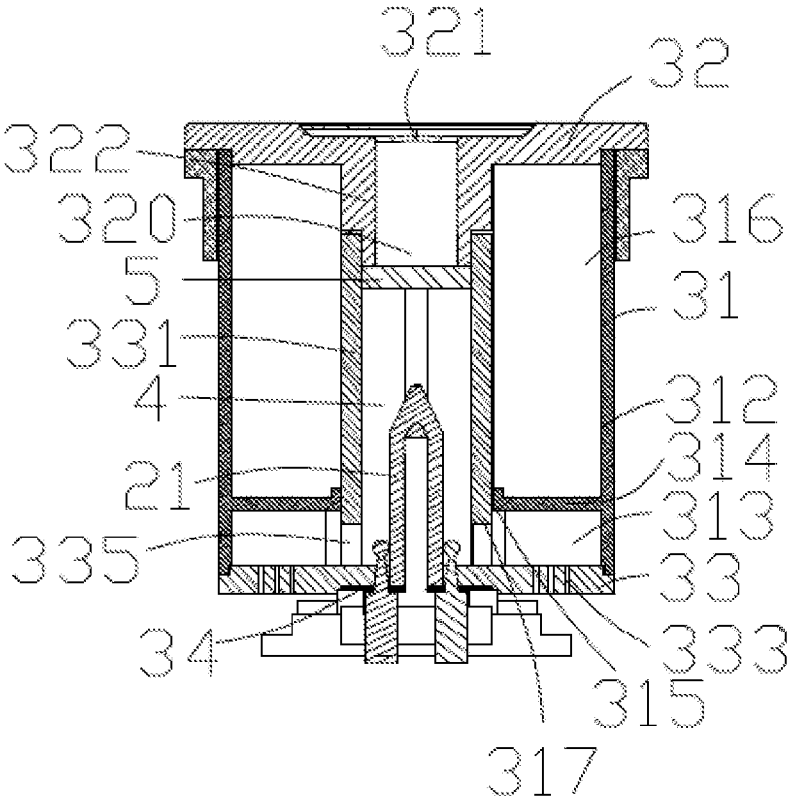
FIG. 6 is a schematic cross-sectional view of the cartridge taken along the line A-A in FIG. 1, in which a heating end of an atomizer device is inserted into an e-liquid carrier of the cartridge.

As shown in FIGS. 3, 5 and 6, the main body 31 includes a casing 311, a partition wall 314 separating the casing 311 into a first chamber 312 and a second chamber 313, a channel (not labeled) extending through the casing 311 and forming a through hole 315 on the partition wall 314, an e-liquid storage member 316 received in the first chamber 312, an annular guide wall 317 extending from the partition wall 314 at an edge of the through hole 315 in a direction away from the first end plate 32, and a second end plate 33 blocking the other end of the casing 311.

As shown in FIGS. 4 and 5, the first end plate 32 includes an annular extension wall 322 extending toward the second end plate 33 and a suction channel 320 formed in the extension wall 322. The suction channel 320 forms a suction port 321 on the first end plate 32. The e-liquid storage member 316 includes a receiving cavity 3160 coaxial with the suction channel 320. The extension wall 322 extends into the receiving cavity 3160. The receiving cavity 3160 communicates with the suction channel 320.

As shown in FIGS. 4 and 5, the second end plate 33 includes an annular wall 331 extending toward the first end plate 32, an air inlet channel 330 formed in the annular wall 331, and a plurality of air inlets 333 extending through the second end plate 33 and in communication with the second chamber 313.

As shown in FIGS. 3 and 4, the air inlet channel 330 extends through the second end plate 33. The cartridge 3 further includes a sealing film 34 and a liner cover 5. The sealing film 34 blocks the air inlet channel 330 of the second end plate 33. The liner cover 5 shields an end of the e-liquid carrier 4 close to the first end plate 32. The liner cover 5 is hollow so as to communicate the air inlet channel 330 and the suction channel 320. The e-liquid carrier 4 is received in the air inlet channel 330. The extension wall 322 presses against the liner cover 5 at an end of the e-liquid carrier 4. In other words, the e-liquid carrier 4 is limited between the second end plate 33 and the liner cover 5.

As shown in FIG. 5, the annular wall 331 extends into the receiving cavity 3160. As shown in FIG. 4, the extension wall 322 extends into the air inlet channel 330. As shown in FIGS. 3, 4 and 6, the second chamber 313 is formed among the second end plate 33, the partition wall 314 and the guide wall 317. As shown in FIGS. 4 to 6, the annular wall 331 is further provided with a plurality of first openings 334 and a plurality of second openings 335 penetrating the annular wall 331. The first openings 334 are used to communicate the air inlet channel 330 and the second chamber 313. The second openings 335 are set corresponding to oil guiding portions 3161 of the e-liquid storage member 316 so that the oil guiding portions 3161 are capable of entering the air inlet channel 330. At the same time, the oil guiding portion 3161 and the second opening 335 are relatively locked with each other so that the e-liquid storage member 316 and the second end plate 33 are relatively fixed with respect to the casing 311.

The oil guiding portion 3161 is provided with a plurality of holes (not labeled) for allowing the e-liquid to seep out. The e-liquid in the e-liquid storage member 316 penetrates onto the e-liquid carrier 4 from the e-liquid storage member 316 through the holes.

In this embodiment, the atomizer device 2 and the cartridge 3 are manufactured separately and then assembled into the cigarette pipe 1. With this arrangement, the atomizer device 2 can be reused, which reduces costs and avoids waste of resources. The atomizer device 2 is entirely received in the cavity 10 of the cigarette pipe 1. The atomizer device 2 includes a needle-shaped heating element 21 which is capable of piercing the sealing film 34, a battery 22 for supplying power to the heating element 21 for heating, a circuit (not labeled) connecting the battery 22 and the heating element 21, a sensor (not labeled) for activating the battery 22, a fixing frame 24 for fixing the battery 22, the circuit, the sensor and the heating element 21, and a sealing member 6 fixed to the heating element 21 in order to achieve sealing between the atomizer device 2 and the cartridge 3. The heating element 21 includes a heating end 211 and a fixing end 212 connected to the heating end 211. The fixing end 212 fixes the heating element 21. The sealing member 6 is a sealing ring sleeved around the heating end 211 and embedded in the fixing end 212. This arrangement can prevent the e-liquid oozing from the cartridge 3 from leaking into the atomizer device 2, so that negative impact to the circuit and the battery 22 in the atomizer device 2 can be avoided. When the sensor receives a gas flow, the battery 22 starts to work. The atomizer device 2 supplies power to the heating element 21 through the circuit, and the heating end 211 of the heating element 21 heats the e-liquid on the e-liquid carrier 4 to atomize the e-liquid.

The above embodiments are only used to illustrate the present disclosure and not to limit the technical solutions described in the present disclosure. The understanding of this specification should be based on those skilled in the art. Descriptions of directions, such as "front", "back", "left", "right", "top" and "bottom", although they have been described in detail in the above-mentioned embodiments of the present disclosure, those skilled in the art should understand that modifications or equivalent substitutions can still be made to the application, and all technical solutions and improvements that do not depart from the spirit and scope of the application should be covered by the claims of the application.

What is claimed is:

1. An electronic cigarette, comprising:

a cigarette pipe, having a cavity;

an atomizer device, received in the cavity, and the atomizer device being provided with a heating element; and a cartridge, detachably installed in the cigarette pipe, the cartridge comprising a main body inserted in the cavity, a channel extending through the main body, an e-liquid storage member detachably installed in the main body, an e-liquid carrier and an end plate, the channel being in communication with the outside, the end plate comprising an annular wall and an air inlet channel formed in the annular wall, the annular wall defining a first opening in communication with the outside and a second opening in communication with the air inlet channel, the e-liquid carrier being detachably received in the air inlet channel, and the e-liquid carrier being capable of absorbing e-liquid in the e-liquid storage member;

wherein the heating element comprises a heating end extending into the e-liquid carrier;

wherein the main body comprises a casing and a partition wall, the partition wall separates the casing into a first chamber and a second chamber, and most of the e-liquid storage member is detachably received in the first chamber;

wherein the e-liquid storage member is provided with an oil guiding portion which extends through the partition wall to protrude into the second chamber, the second opening is exposed to the second chamber, and the oil guiding portion corresponds to the second opening so as to direct the e-liquid from the e-liquid storage member to the e-liquid carrier; and wherein the e-liquid carrier is a glass fiber cotton core, and the heating end is configured to heat and atomize the e-liquid on the e-liquid carrier.

2. The electronic cigarette according to claim 1, wherein the end plate further comprises a first end plate fixed to one end of the main body and a second end plate fixed to the other end of the main body.

3. The electronic cigarette according to claim 2, wherein the cartridge further comprises a suction port extending through the first end plate, and the channel communicates with the outside through the suction port.

4. The electronic cigarette according to claim 2, further comprising a sealing member located between the cartridge and the atomizer device, the heating element further comprising a fixing end fixing the heating end, wherein the sealing member is mounted to the fixed end so that the cartridge and the atomizer device are relatively sealed.

5. The electronic cigarette according to claim 3, wherein the second end plate comprises the annular wall extending toward the first end plate.

6. The electronic cigarette according to claim 5, wherein the second end plate comprises a plurality of air inlets extending through the second end plate, a plurality of the first openings and a plurality of the second openings are provided extending through the annular wall, the plurality of air inlets are in communication with the first openings through the second chamber, and the second chamber is in communication with the air inlet channel through the first openings.

7. The electronic cigarette according to claim 1, wherein the oil guiding portion protrudes into the air inlet channel through the second opening.

8. The electronic cigarette according to claim 1, wherein the e-liquid storage member is provided with a receiving cavity coaxial with the air inlet channel, and the annular wall is received in the receiving cavity.

9. The electronic cigarette according to claim 5, wherein the air inlet channel extends through the second end plate, the electronic cigarette further comprises a sealing film blocking the air inlet channel, and the heating end pierces the sealing film and enters the air inlet channel to directly or indirectly contact the e-liquid carrier.

10. The electronic cigarette according to claim 1, wherein the oil guiding portion is locked in the second opening.

11. The electronic cigarette according to claim 5, wherein the first end plate comprises an extension wall and a suction channel formed in the extension wall, the extension wall extending toward the second end plate and being received in the channel, the suction port communicating with the air inlet channel through the suction channel.

12. The electronic cigarette according to claim 11, wherein the extension wall extends into the air inlet channel and is at least partially surrounded by the annular wall.

13. An electronic cigarette, comprising:

a cigarette pipe defining a cavity;

an atomizer device received in the cavity, the atomizer device being provided with a heating element; and a cartridge detachably installed in the cigarette pipe, the cartridge comprising a main body inserted in the cavity, a channel extending through the main body, an e-liquid storage member detachably installed in the main body, an e-liquid carrier, a hollow liner cover, a first end plate and a second end plate; the channel being in communication with the outside, the first end plate comprising an extension wall and a suction channel extending through the extension wall, the second end plate comprising an annular wall and an air inlet channel formed in the annular wall, the annular wall defining a first opening in communication with the outside and a second opening in communication with the air inlet channel, the e-liquid carrier being detachably received in the air inlet channel, the hollow liner cover is received in the air inlet channel, the extension wall being at least partially received in the air inlet channel, the hollow liner cover being clamped between the extension wall and the e-liquid carrier, and the e-liquid carrier being configured to absorb e-liquid in the e-liquid storage member;

wherein the main body comprises a casing and a partition wall, the partition wall separates the casing into a first chamber and a second chamber, and most of the e-liquid storage member is detachably received in the first chamber;

wherein the e-liquid storage member is provided with an oil guiding portion which extends through the partition wall to protrude into the second chamber, the second opening is exposed to the second chamber, and the oil guiding portion corresponds to the second opening so as to direct the e-liquid from the e-liquid storage member to the e-liquid carrier; and wherein the heating element is configured to heat and atomize the e-liquid on the e-liquid carrier into a gaseous state, and the e-liquid in the gaseous state flows through the channel to the suction channel.

14. The electronic cigarette according to claim 13, wherein the e-liquid carrier is a glass fiber cotton core.

15. The electronic cigarette according to claim 14, wherein the e-liquid carrier is of a cylindrical configuration, and the e-liquid carrier defines a through channel in communication with the channel.

16. The electronic cigarette according to claim 13, wherein the second end plate comprises a plurality of air inlets extending through the second end plate, the plurality of air inlets are in communication with the first opening through the second chamber, and the second chamber is in communication with the air inlet channel through the first opening.

17. The electronic cigarette according to claim 13, wherein the oil guiding portion protrudes into the air inlet channel through the second opening.

18. The electronic cigarette according to claim 13, wherein the oil guiding portion is locked in the second opening.

19. The electronic cigarette according to claim 13, wherein the e-liquid storage member is provided with a receiving cavity coaxial with the air inlet channel, and the annular wall is received in the receiving cavity.

20. The electronic cigarette according to claim 13, wherein the air inlet channel extends through the second end plate, the electronic cigarette further comprises a sealing film blocking an end of the air inlet channel, and the heating element pierces the sealing film so as to enter the air inlet channel to directly or indirectly contact the e-liquid carrier.

* * * * *